US011692508B2

(12) United States Patent
Bailey et al.

(10) Patent No.: US 11,692,508 B2
(45) Date of Patent: Jul. 4, 2023

(54) DUAL STIRLING CYCLE LIQUID AIR BATTERY

(71) Applicant: The United States of America, as represented by the Secretary of the Navy, Arlington, VA (US)

(72) Inventors: Nicholas Anthony Bailey, Monterey, CA (US); Christopher Michael Girouard, Seaside, CA (US); Anthony Gerard Pollman, Monterey, CA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/393,275

(22) Filed: Aug. 3, 2021

(65) Prior Publication Data

US 2022/0042478 A1 Feb. 10, 2022

Related U.S. Application Data

(60) Provisional application No. 63/061,060, filed on Aug. 4, 2020.

(51) Int. Cl.
*F02G 1/057* (2006.01)
*F02G 1/055* (2006.01)
(Continued)

(52) U.S. Cl.
CPC ..... *F02G 1/057* (2013.01); *F02G 1/055* (2013.01); *F17C 7/04* (2013.01); *F17C 9/04* (2013.01); *F25B 9/14* (2013.01); *F25J 1/0012* (2013.01); *F25J 3/04472* (2013.01); *F25J 3/04496* (2013.01); *F02G 2243/00* (2013.01);
(Continued)

(58) Field of Classification Search
CPC ..... F02C 6/14; F02C 6/16; F02G 2256/00; F02G 2256/02
See application file for complete search history.

(56) References Cited

U.S. PATENT DOCUMENTS

2006/0026988 A1* 2/2006 Unger ..... F25J 3/04278 62/643

FOREIGN PATENT DOCUMENTS

| | | | | |
|---|---|---|---|---|
| CN | 104500264 A | * | 4/2015 | ..... F02G 1/043 |
| JP | 2010243017 A | * | 10/2010 | ..... F25J 1/0015 |
| KR | 20200071500 A | * | 6/2020 | |

* cited by examiner

*Primary Examiner* — Laert Dounis
(74) *Attorney, Agent, or Firm* — Naval Postgraduate School; Scott Bell

(57) ABSTRACT

The invention relates to a liquid air energy storage system. The storage system includes a cryocooler, a dewar, and a Sterling engine. The cryocooler cools a tip of a cold head to cryogenic temperatures, the cryocooler further includes a heat sink to reject heat from the cryocooler and a cold head that protrudes into a dewar through a cryocooler cavity, the cold head to condense ambient air to create liquified air in the dewar. The dewar holds the liquified air at low temperatures, the dewar having the cryocooler cavity and a Stirling cavity. The Stirling engine drives an electric generator, the Stirling engine further including a cold finger protruding into the dewar through the Stirling cavity, the cold finger to move the liquified air from the dewar to a Stirling heat sink; the Stirling heat sink to expand the liquified air; and the electric generator to generate output electricity.

13 Claims, 5 Drawing Sheets

(51) Int. Cl.

| | |
|---|---|
| ***F17C 7/04*** | (2006.01) |
| ***F17C 9/04*** | (2006.01) |
| ***F25B 9/14*** | (2006.01) |
| ***F25J 1/00*** | (2006.01) |
| ***F25J 3/04*** | (2006.01) |

(52) U.S. Cl.
CPC .... *F02G 2256/00* (2013.01); *F17C 2221/031* (2013.01); *F17C 2223/0161* (2013.01); *F17C 2265/07* (2013.01)

DUAL STIRLING CYCLE LIQUID AIR BATTERY

CROSS-REFERENCE TO RELATED APPLICATIONS

This patent application is a non-provisional of and claims the benefit of U.S. Provisional application 63/061,060, filed Aug. 4, 2020, which is hereby incorporated by reference in its entirety.

BACKGROUND OF THE INVENTION

1. Field of the Invention

The present invention relates generally to methods and systems for using liquid air energy storage.

2. Description of the Related Art

Large scale power production systems and smaller microgrids are increasingly dependent on renewable sources for generation of power. However, these sources are intermittent and lack the stability of non-renewable sources while requiring additional infrastructure to ensure constant energy flow. There are a variety of methods currently used to store energy though each has their own advantages and limitations. For example, pumped hydro storage requires two reservoirs and an elevation change, so the technology application would be constrained by geography and not be suitable for a movable microgrid in support of mobile operations.

One promising technology is Liquid Air Energy Storage (LAES), in which excess energy is used to cool and cryogenically store air. When that energy is needed, the liquid air is expanded and turns a turbine to generate power. While having the advantages of hydro and compressed air, it is not geographically constrained or require large tanks. The first large-scale operational plant of this type was recently of this type opened in 2016 at the University of Birmingham, UK, and uses waste heat from a nearby landfill-gas powered generation facility to improve overall efficiency.

SUMMARY OF THE INVENTION

Embodiments described herein describe a liquid air energy storage system. The storage system includes a cryocooler, a dewar, and a Sterling engine. The cryocooler cools a tip of a cold head to cryogenic temperatures, the cryocooler further includes a heat sink to reject heat from the cryocooler and a cold head that protrudes into a dewar through a cryocooler cavity, the cold head to condense ambient air to create liquified air in the dewar. The dewar holds the liquified air at low temperatures, the dewar having the cryocooler cavity and a Stirling cavity. The Stirling engine drives an electric generator, the Stirling engine further including a cold finger protruding into the dewar through the Stirling cavity, the cold finger to move the liquified air from the dewar to a Stirling heat sink; the Stirling heat sink to expand the liquified air; and the electric generator to generate output electricity.

Embodiments in accordance with the invention are best understood by reference to the following detailed description when read in conjunction with the accompanying drawings.

Embodiments in accordance with the invention are further described herein with reference to the drawings.

DETAILED DESCRIPTION OF THE INVENTION

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a creation authoring point tool utility.

Generally, LAES systems have two subsystems: the compression side and the expansion side. On the compression side of a traditional LAES system, ambient air is fed into a compressor, which pushes hot high-pressure air to a compression heat exchanger. The heat exchanger cools the compressed air, which is then fed to a valve, where it is expanded to produce liquefied air. The liquefied air is stored in the cryogenic liquid reservoir (i.e., dewar). Any air that is not liquefied is recycled back to the compressor. When energy is required, the liquid is pumped out of the reservoir, heated on the expansion side through a heat exchanger, and expanded to spin a turbine. The turbine drives a connected generator to produce electricity. The compression and expansion sides are isolated by control valves and do not operate at the same time.

Embodiments of the invention use a "cold finger" (i.e., "cold head") cryocooler to rapidly cool and liquefy ambient air for storage. Low pressure air is filtered and dried and pumped into a cryogenic containment vessel (dewar). The air can then be rapidly cooled using a cryocooler, which is designed as a "cold finger" variant which condenses outside air into a liquid form. This liquid is stored in the dewar until additional energy outside of current capacity is required. When additional energy is required, the liquid air is sent via a second cold finger that protrudes into the dewar to a Stirling engine, which then rapidly cools the external displacement piston. This cooling then produces a temperature difference great enough to cause a compression within the engine regenerator. The compression produces work to be done on the pistons, which are connected to a flywheel and generator, producing electricity.

Figure 1:
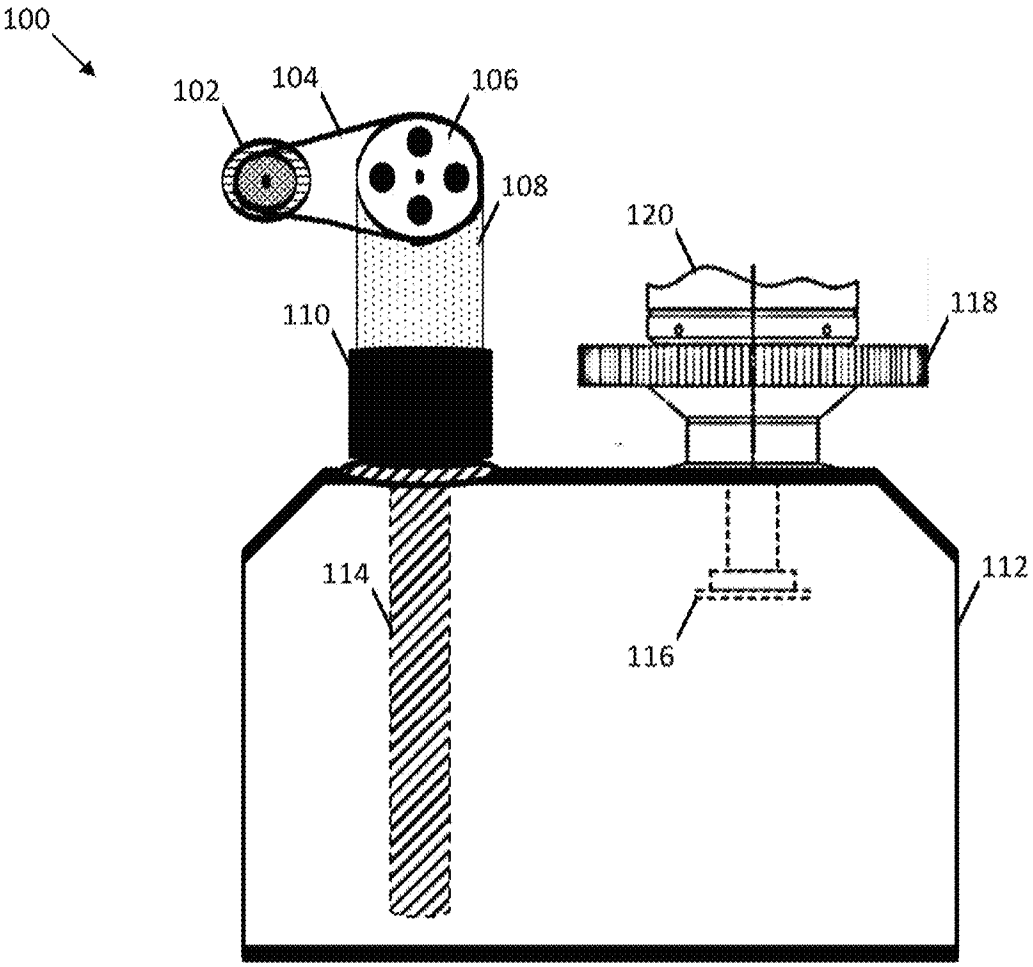
FIG. 1 illustrates a liquid air energy storage (LAES) system in accordance with embodiments described herein.

FIG. 1 illustrates an LAES system 100 in accordance with embodiments described herein. The primary components of the LAES system 100 include the cryocooler 120, the dewar 112, and the Stirling engine 108.

The cryocooler 120 is a contained system that takes electricity and cools the tip of a cryocooler cold head 116 to very cold temperatures. Heat is rejected through the cryocooler heat sink 118 located around the base of the cryocooler 120. In this example, the cryocooler 120 sits atop a plate on the vacuum insulated dewar 112 with only the cryocooler cold head 116 inside the dewar 112. The cold temperature at the tip of the cryocooler cold head 116 causes air to liquefy and drop to the bottom of the dewar 112. An example cryocooler 120 and dewar 112 are described below with respect to FIG. 2.

The dewar 112 is a vacuum insulated container designed to hold low-temperature liquids. This allows the liquid to be stored without immediately boiling off. A top of the dewar 112 is designed with holes large enough to fit the Stirling cold finger 114 and the cryocooler cold head 116. In some embodiments, the Stirling cold finger 114 has a 220 K temperature differential.

In this example, the Stirling engine 108 is a linear (beta) type that had a long, copper extension (i.e., cold finger 114) from the head of the Stirling engine 108 to the bottom of the dewar 112. This allows for heat conduction to the liquid at the bottom of the dewar 112 and improves the Stirling engine's 108 ability to operate. Above the cold finger extension 114, the Stirling engine 108 sits on a plate on top of the dewar 112, which in this example the same plate that the cryocooler 120 sits on. The hot side of the Stirling engine 108 is the Stirling heat sink 110, which sits at ambient temperature. The Stirling engine 108 rotates a pulley wheel 106 that is connected via pulley 104 to an electric generator 102. When the Stirling engine 108 operates, the electric generator 102 can spin and generate electricity. An example Sterling Engine 108 is described below with respect to FIG. 3.

The LAES system 100 can be configured to have various operating parameters. For example, air mass flowrates of 1-100 kg/h and pressure ratios of 5.9-7.0 can be used, which correspond to output pressures of 3000-6000 psi. These output pressures are within the range of estimates of best performing output pressures (2900-7200 psi).

Figure 2:
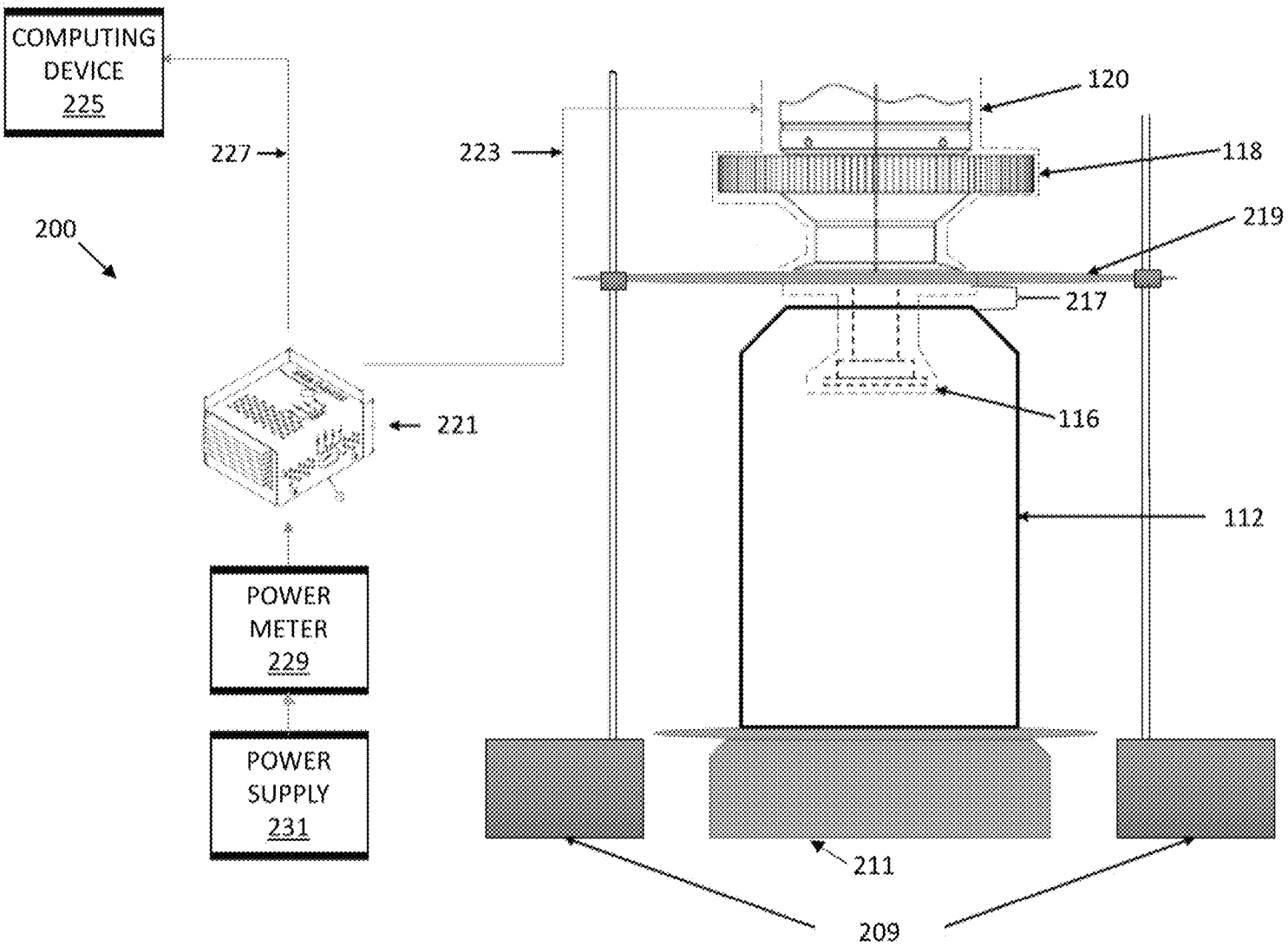
FIG. 2 illustrates an example cryocooler system in accordance with embodiments described herein.

FIG. 2 illustrates an example cryocooler system 200 in accordance with embodiments described herein. The cryocooler system 200 has two major components: a Stirling cryocooler 120 and a dewar 112. Like numbered components of cryocooler system 200 may be the same or similar as the corresponding components described above with respect to FIG. 1.

In some embodiments, the operational temperature of the cryocooler system 200 is below 78K (−196° C.) in order to produce liquid air from ambient air at atmospheric pressure. For example, the system 200 can use a Cryotel GT 16 W cryocooler 120, which is a commercially available Stirling cryocooler 120 outfitted with a controller 221 and a heat sink 118 (e.g., fins) for convective heat rejection. The controller 221 can be connected 223 to the cryocooler 120 for the transmission of power and data. The cryocooler system 200 can also include an RTD (resistive temperature detector) (not shown), which feeds cold tip temperature to the controller 221. The vacuum insulated containers (used as dewars) 112 can be placed on a mass balance 211 that can measure liquid yield as a change in mass. The cryocooler 120 can be suspended on a rig that leaves a gap 217 of −1 mm between the lip of the container 112 and the bottom of an acrylic plate 219. This gap 217 may serve as an inlet for air to be cooled as well as separation so only the dewar 112 is weighed. The cryocooler can also include a mass balance 209 such as the Jscale J-600, which has a 0.1 g precision. The scale 209 can be user calibrated prior to operation of the cryocooler system 200.

In addition to supporting the cooler 120, the acrylic plate 219 can provide a barrier from the fins 118 to reduce convection in the dewar 112 and minimize heat loss. Power can be supplied to the cooler controller 221 using a power supply 231 (e.g., the Kikusui PWX1500ML DC rated at 1500 W). Total system 200 power can be monitored using a power meter 229 (e.g., the Rcharlance 150 A power monitor) that is installed between the supply 231 and controller 221. In one example, the controller 221 is connected via serial USB cable 227 to a computing device 225, which communicates using a generic serial interface. In this example, the interface allows power levels to be adjusted as well as provided cold tip temperature, power, and other operating parameters.

Various sized and shaped containers can be used for the dewar 112, which result in differences in liquid yield. Examples of containers include, but are not limited to, 473 mL (16 oz) container with a length to diameter (L/D) 1.285, 473 mL (16 oz) container with a LID of 2.453, 354 mL (12 oz) container with a L/D of 2.453, 946 mL (32 oz) container with a LID of 2.453, etc. Various cooler power levels can be applied via the power supply 231 such as 175 W, 190 W, 215 W, 240 W, etc.

Large scale implementations with collocated regenerative capabilities should run much less efficiently. Models describer here estimate that on average, 11.32 liters of liquid air should produce 1 kWh of electricity. This production rate estimation could be used as a multiplier in determining the correct tank size and expansion system design. For example, to fulfill the constraint of 5 kWh, approximately 57 liters of liquid storage capacity should be used.

Experiments were conducted with various operating parameters as described above. In 10-minute intervals, the instantaneous cooler power, total consumed power, cold tip temperature, and liquid yield was measured. The experimental results show that the dewar 112 shape differences are not statistically significant for the sizes listed above. The relationships found for liquid yield are linear and the following, accurate estimation equation was developed:

$$\text{Liquid Yield}(g)=(0.1538\times\text{Power})+(-0.0174\times\text{Volume})+(0.9222\times\text{Time})-33.235 \quad (1)$$

This is a significant relationship between the measured variables and liquid yield. However, this model does not take into consideration the transient startup effects and only functions as a predictor for steady state performance. In addition to the linear regression, the effect of variable interactions was also investigated using modeling software. As time was used as a measurement point and not an independent variable, the only interaction considered was power and volume. As noted above, it was found that variable interaction was not a significant factor that affected the liquid yield and the standard linear model was accepted.

Further testing could include longer runs for the shape analysis portion of other embodiments. This could identify if longer generation periods have a different effect on liquid generation. Additionally, more types of containers could be used with different shapes to see if more significant L/D variation would have any effect. Further testing for the multi-factor runs could include greater power and container sizes, as well as longer runs to ensure linear behavior.

In the experiments, the liquid production is linear with its transients occurring within the first 40 minutes of operation. In each run, the cooler head 116 reached a low enough temperature within 20 minutes to start liquid production. Though the time to produce the first gram varied depending on the varied operating parameter variables, even the lowest power and largest size produced measurable liquid quickly in the tests. However, if much larger volumes and power are used, transients may have a greater effect on ramp up time than these experiments show. The resulting equation accurately predicts small-volume and lower power liquid yield and could be used as a model to inform the trade space of a small, mobile cryocooler system 200.

Figure 3:
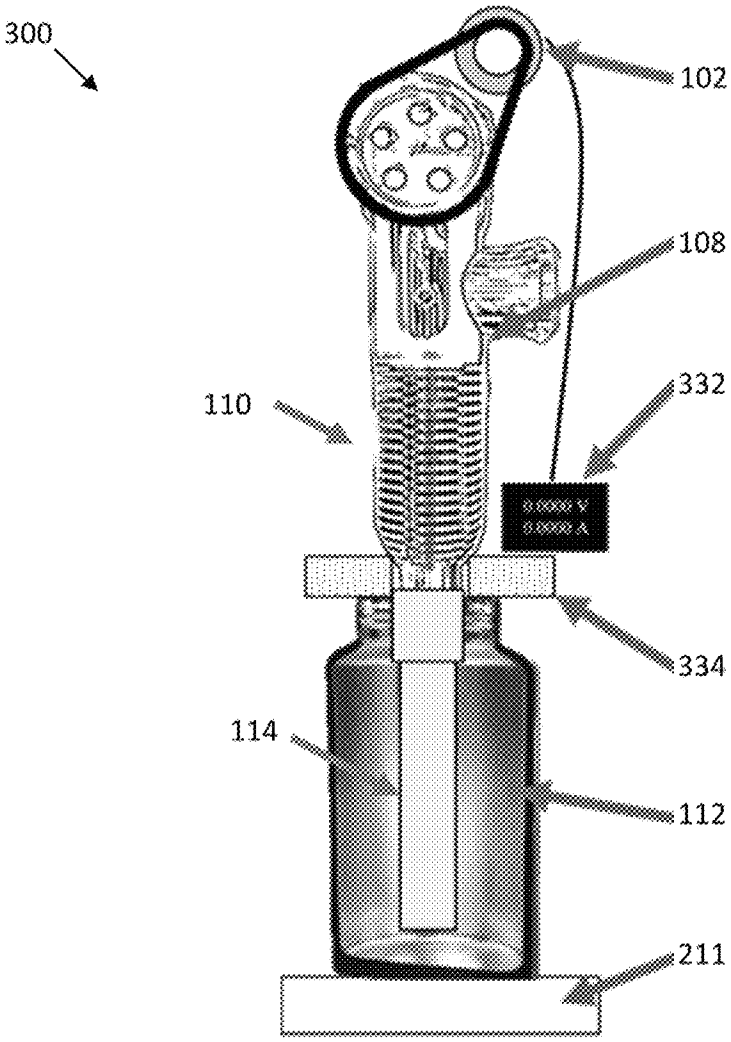
FIG. 3 illustrates an example Sterling Engine system in accordance with embodiments described herein.

FIG. 3 illustrates an example Sterling Engine system 300 in accordance with embodiments described herein. The Sterling Engine system 300 has two major components: a Stirling engine 108 and a dewar 112. Like numbered components of Sterling Engine system 300 may be the same or similar as the corresponding components described above with respect to FIGS. 1-2.

An example Stirling engine 108 is the Kontax KS18 beta-type Stirling engine, which is normally used as a desktop model. One of the output flywheels 106 of the system 300 can coupled by a pulley 104 to an electric generator 102. The output of the electric generator 102 can be connected to a power monitor 332 that displays voltage and current precise to four decimal places. Connected to the output of the power monitor 332 was the resistive load (not shown) for the system 300. This resistive load can be variable, for example, ranging from twenty-two to seventy-five ohms. Temperature of the heater component can be monitored with a thermocouple placed on the heat sink 110 of the Stirling engine 108.

The input to the Stirling engine 108 can be connected, for example, to a solid copper rod 114 to extend the cold side of the engine further into the dewar containing liquid air. The contact surfaces of these two components 108, 114 were butted together tightly to ensure that there was complete conductive heat transfer between them. An example dewar 112 is a twelve-ounce Hydro Flask stainless steel vacuum insulated wide mouth thermos. The dewar 112 can be placed on a mass balance precise to 0.1 grams.

The overall energy efficiency and energy density of the recovery Stirling engine 108 can be determined by measuring and calculating the total energy required to vaporize the mass of liquid air consumed versus the total energy measured as an output to the system 300. Energy output can be measured as electrical voltage and current output from a coupled electrical generator 102 to the output of the Stirling engine 108. During experimentation, measurements were taken at fifteen second intervals over a five-minute period. Because the output was electrical, the load resistance at which voltage and current were measured was varied to see what effect, if any, it had on output.

The experimentation shows that load is not a factor when designing for energy output of the system 300. Efficiencies measured in both energy density and using latent heat of vaporization show that the system 300 is operating at the calculated capability.

The system 300 can be optimizing by reconfiguring components and minimizing thermal losses. One such improvement may be to isolate the hot end of the engine 108 out of the environment and extend the conductive cold tip 114 of the engine into the dewar 112. This should dramatically cut heat gain from the environment and keep the temperature difference high. Another improvement may be to submerge the hot end of the engine 108 into a fluid such as water with very high latent heat values. This should serve the same function as the previous, keeping the hot temperature constant and temperature difference high. Last, a better electrical generation method can be explored to reduce losses and take advantage of the linear reciprocation method of the beta type Stirling engine 108.

Figure 4:
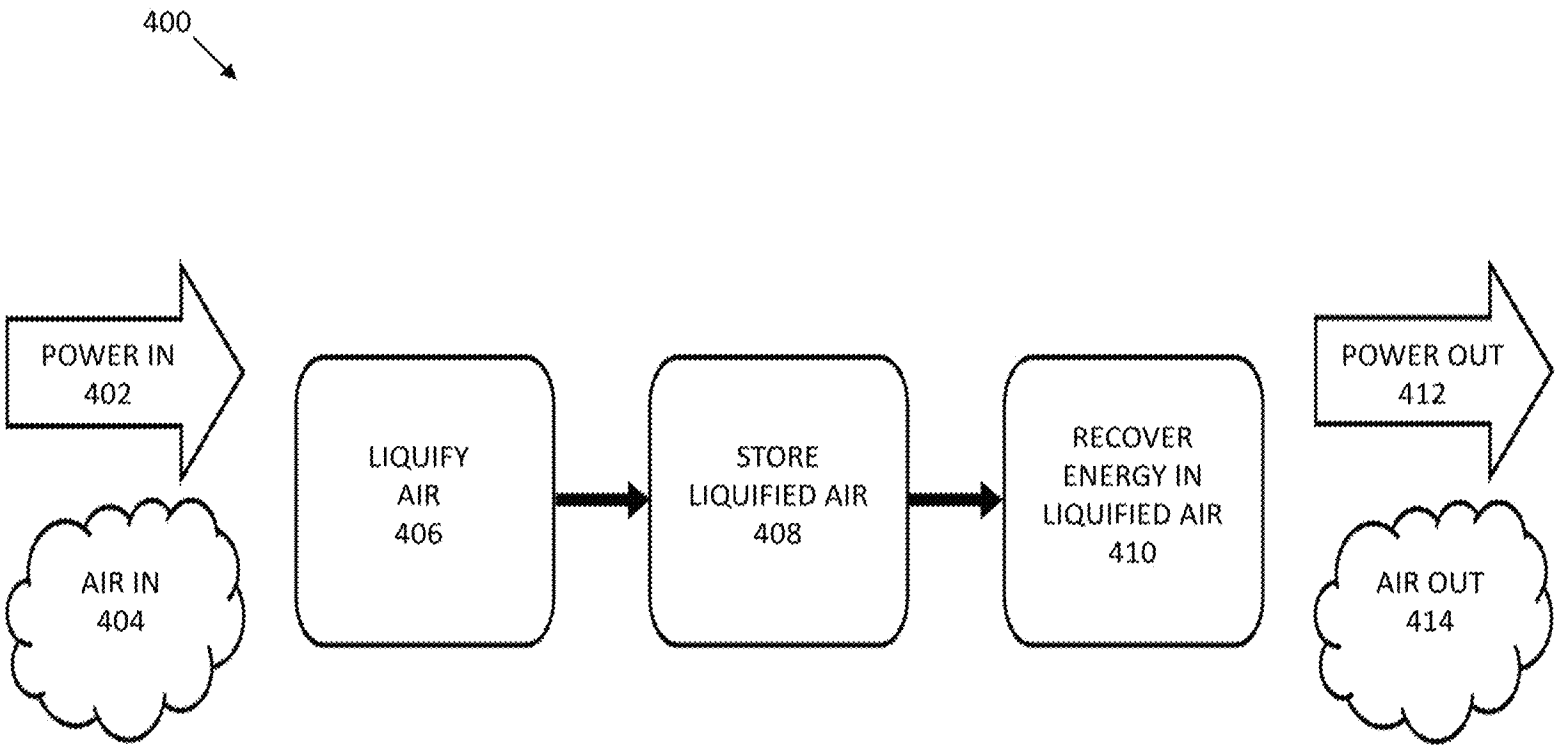
FIGS. 4-5 show example workflows for operating an LAES system in accordance with embodiment described herein.

FIG. 4 shows an example simplified workflow 400 for operating an LAES system in accordance with embodiment described herein. Various embodiments may not include all the steps described below, may include additional steps, and may sequence the steps differently. Accordingly, the specific arrangement of steps described with respect to FIG. 4 should not be construed as limiting the scope of operating an LAES system.

The simplified workflow 400 may be described as a Linde-Hampson cycle for a LAES system. In block 402, power is captured into the LAES system by intaking air 404. Specifically, the ambient air is compressed and then rapidly, isentropically expanded, cooling it in the process in block 406. When the air reaches sufficiently cold temperature to change phase, the liquid air drops into a storage dewar for later use in block 408. To generate energy in a Linde-Hampson cycle LAES system, the liquid air is heated and expanded in block 410. In block 412, the work created is used to drive a turbine generator as air is driven out 414. The air expands to roughly 800 times it's liquid volume as a vapor.

There are a number of difficulties to overcome to implement this simplified workflow 400. While all LAES systems implement cryogenic components and storage for the liquid air, the Linde-Hampson cycle also introduces high pressures associated with the liquefication function. An optimized Linde-Hampson cycle LAES system must achieve pressures of 3000-6000 psi to maximize liquid yield. These factors make such a system more difficult to build and implement. Cryogenic temperatures are associated with most if not all LAES systems inherently, but the high pressures can be eliminated by choosing a different generation and extraction method as described herein.

An ideal Stirling engine will have efficiency based only on the difference of temperature between the heater ($T_H$) and cooler ($T_C$) as described in equation (2) below:

$$\varepsilon = 1 - \frac{T_C}{T_H} \tag{2}$$

This equation represents only the ideal case, however. To more precisely estimate the efficiency of a real-world Stirling engine, more direct measurements should be made. However, Stirling remains a high efficiency cycle at the building scale.

For the dual-Stirling engine LAES systems described herein, the cooler suppling $T_C$ is supplied by the liquefied air stored within the system. As the liquid air heats, it undergoes a phase change to a vapor. The energy required to evaporate is expressed as the latent heat of vaporization. This quantity can be expressed on a per mass basis; therefore, by measuring the change in mass, the total energy required to vaporize the mass lost can be calculated. This quantity, when compared to the total energy output of the LAES system, is the actual achieved efficiency of the system.

Because the cycle is running much like a refrigerator, ideal Stirling cycle refrigeration coefficient of performance may better represent the efficiency of the cycle investigated as described in equation (3) below:

$$COP = \frac{T_C}{T_H - T_C} \tag{3}$$

Figure 5:
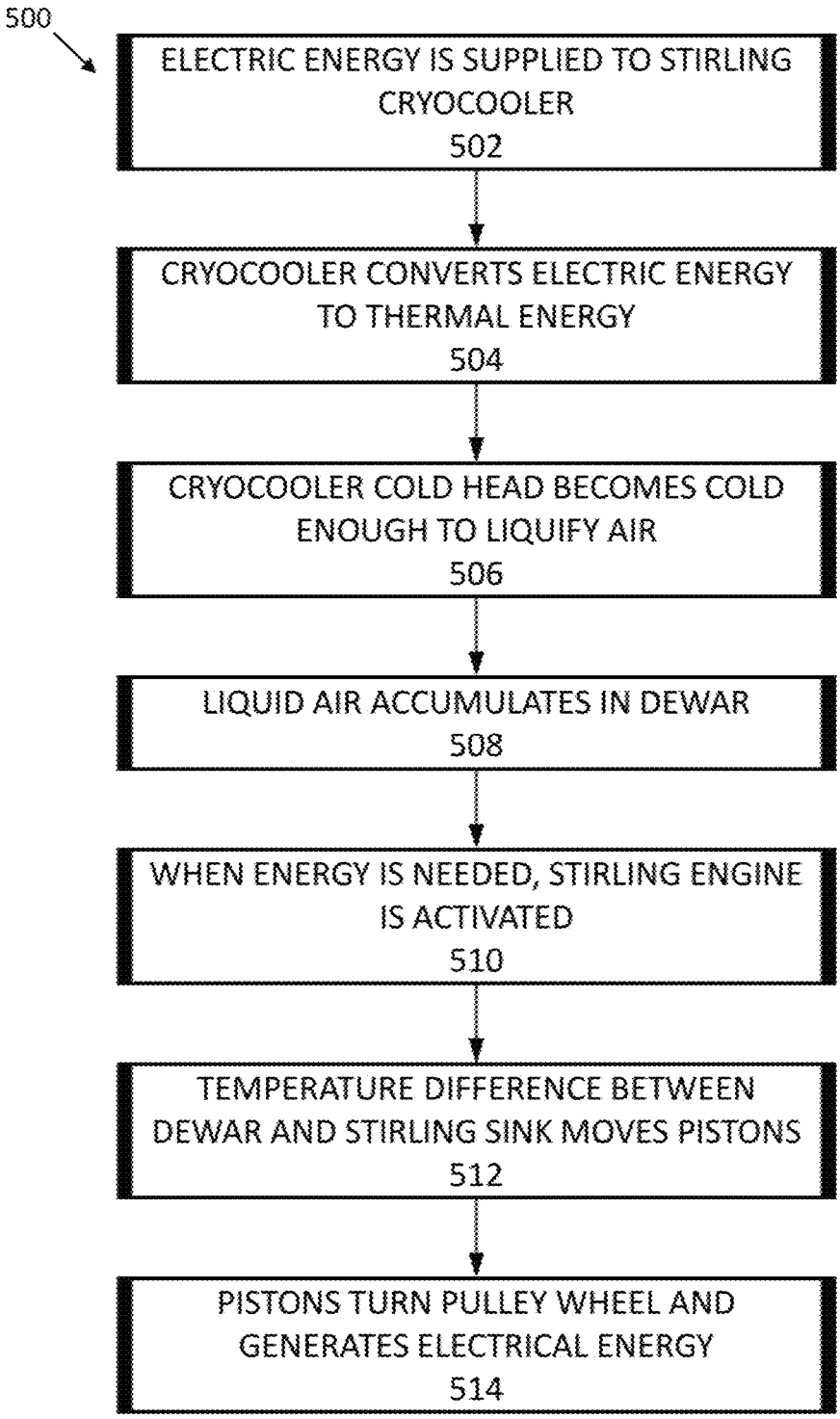

FIG. 5 shows an example detailed workflow for operating an LAES system in accordance with embodiment described herein. Various embodiments may not include all the steps described below, may include additional steps, and may sequence the steps differently. Accordingly, the specific arrangement of steps described with respect to FIG. 5 should not be construed as limiting the scope of operating an LAES system.

In step 502, electrical energy is supplied to the Stirling cryocooler. In step 504, the cryocooler converts electrical energy to thermal energy, which causes the cold finger to be cooled and heat to be rejected through the cryocooler heat sink to the environment. In step 506, the cryocooler cold head reaches a temperature cold enough to cause ambient, gaseous air to liquefy. In step 508, the liquid air drips from the cold head and accumulates at the bottom of the dewar. The liquid air collects and is stored until there is no electrical energy available, causing the cryocooler to stop. Steps 502-208 describe the process by which energy is stored in the LAES system in the form of liquified air.

When additional energy is needed, the Stirling engine can be started by turning the Stirling engine pully wheel in step 510. The Stirling engine continues to work due to a temperature difference between the copper cold finger extension (in contact with the stored liquid air) and the ambient air temperature of the Stirling engine heat sink. Tue copper finger extends the cold side of the Sterling engine further into the dewar to improve performance. In step 512, the temperature difference causes pistons inside the Stirling engine to move thereby turning the Stirling engine pulley wheel. In step 514, the pulley wheel, which is connected via pulley to the electric generator pully wheel, spins the electric generator to produce electrical energy. Steps 510-214 describe the process by which the stored energy is converted back to electric energy for use.

This description provides exemplary embodiments of the present invention. The scope of the present invention is not limited by these exemplary embodiments. Numerous variations, whether explicitly provided for by the specification or implied by the specification or not, may be implemented by one of skill in the art in view of this disclosure.

It is to be understood that the above-described arrangements are only illustrative of the application of the principles of the present invention, and it is not intended to be exhaustive or limit the invention to the precise form disclosed. Numerous modifications and alternative arrangements may be devised by those skilled in the art in light of the above teachings without departing from the spirit and scope of the present invention.

What is claimed is:

1. A recovery engine comprising:

a cryocooler to cool a tip of a cold head to cryogenic temperatures, the cryocooler further comprising:

a heat sink to reject heat from the cryocooler, and the cold head that protrudes into a dewar through a cryocooler cavity, the cold head to condense ambient air to create liquified air in the dewar;

the dewar to hold the liquified air at low temperatures, the dewar having the cryocooler cavity and a Stirling cavity; and a Stirling engine to drive an electric generator, the Stirling engine further comprising:

a cold finger protruding into the dewar through the Stirling cavity, the cold finger to extend a cold side of the Stirling engine into the liquified air of the dewar, a Stirling heat sink at ambient temperature to form a hot side of the Stirling engine, the hot side and the cold side of the Stirling engine causing a temperature difference that drives the electric generator, and the electric generator to generate output electricity.

2. The recovery engine of claim 1, wherein the dewar is a vacuum insulated container.

3. The recovery engine of claim 1, wherein the Stirling engine further comprises a pulley wheel.

4. The recovery engine of claim 1, wherein the dewar has a capacity of at least 57 liters.

5. The recovery engine of claim 1, wherein the cold finger has around a 220 K temperature differential.

6. The recovery engine of claim 1, further comprising a plate positioned between the cryocooler and the dewar, the plate forming a gap between a lip of the dewar and a bottom of the plate.

7. The recovery engine of claim 6, wherein the gap is approximately 1 mm.

8. A method for storing energy in liquified air, the method comprising:

using a cryocooler to cool the tip of a cold head to cryogenic temperatures;

condensing air at the cold head to collect the liquified air in a dewar;

after activating a Stirling engine that has a cold finger in the liquified air of the dewar, generating a temperature difference between the cold finger and a heat sink of the Stirling engine to drive a pulley wheel of the Stirling engine; and driving an electric generator with the pulley wheel to generate output electricity.

9. The method of claim 8, wherein the dewar is a vacuum insulated container.

10. The method of claim 8, wherein the Stirling heat sink rests at ambient temperature.

11. The method of claim 8, wherein the dewar has a capacity of at least 57 liters.

12. The method of claim 8, wherein the cold finger is maintained at a 220 K temperature differential.

13. The method of claim 8, wherein the air is pulled in over the cold head through a gap between a bottom surface of a plate and a lip of the dewar.

* * * * *